US011091347B2

(12) United States Patent
Barnes et al.

(10) Patent No.: US 11,091,347 B2
(45) Date of Patent: Aug. 17, 2021

(54) LATERAL TRANSLATION OF AN OUTPUT BIN BASED ON MEDIA STACK HEIGHT

(71) Applicant: Hewlett-Packard Development Company, L.P., Spring, TX (US)

(72) Inventors: Arthur H Barnes, Vancouver, WA (US); Jody L Clayburn, Vancouver, WA (US); Francisco Javier Gomez Maurer, Vancouver, WA (US); Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 139 days.

(21) Appl. No.: 16/606,603

(22) PCT Filed: Apr. 21, 2017

(86) PCT No.: PCT/US2017/028944
§ 371 (c)(1),
(2) Date: Oct. 18, 2019

(87) PCT Pub. No.: WO2018/194677
PCT Pub. Date: Oct. 25, 2018

(65) Prior Publication Data

US 2020/0039779 A1 Feb. 6, 2020

(51) Int. Cl.

| | |
|---|---|
| ***B65H 43/06*** | (2006.01) |
| ***B65H 31/24*** | (2006.01) |
| ***B65H 43/08*** | (2006.01) |

(52) U.S. Cl.
CPC ..... *B65H 43/06* (2013.01); *B65H 31/24* (2013.01); *B65H 43/08* (2013.01); *B65H 2301/4212* (2013.01); *B65H 2301/4213* (2013.01); *B65H 2511/152* (2013.01)

(58) Field of Classification Search
CPC ..... B65H 2405/32; B65H 31/30
See application file for complete search history.

(56) References Cited

U.S. PATENT DOCUMENTS

| | | | |
|---|---|---|---|
| 5,599,009 | A | 2/1997 | Mandel et al. |
| 5,797,596 | A | 8/1998 | Morigami et al. |
| 6,176,480 | B1 | 1/2001 | Yonenuma et al. |
| 6,328,298 | B1 | 12/2001 | Suzuki et al. |
| 9,069,315 | B2 | 6/2015 | Caneza et al. |

(Continued)

OTHER PUBLICATIONS

Efficient Solutions for the Printing Industry, (technical Specifications)., Sep. 20, 2012, <https://www.mysick.com/saqqara/im0047526.pdf > 76 pages.

*Primary Examiner* — Jennifer Bahls
(74) *Attorney, Agent, or Firm* — Mannava & Kang

(57) ABSTRACT

According to examples, a printing apparatus may include an output bin that is laterally translatable between a retracted position and an extended position. The printing apparatus may also include a sensor to detect a height of a stack of media on the output bin while the output bin is in the retracted position and a controller. The controller may determine whether the detected height of the stack of media on the output bin exceeds a certain level and in response to a determination that the detected height of the stack of media exceeds the certain level, laterally translate the output bin from the retracted position to the extended position.

15 Claims, 7 Drawing Sheets

(56) References Cited

U.S. PATENT DOCUMENTS

| | | | | |
|---|---|---|---|---|
| 2002/0158405 | A1* | 10/2002 | Nagasako | B65H 31/24 271/213 |
| 2004/0140611 | A1 | 7/2004 | Mui et al. | |
| 2009/0309296 | A1* | 12/2009 | Taki | B65H 31/3063 271/220 |
| 2012/0050809 | A1 | 3/2012 | Kobayassssshi | |
| 2012/0251131 | A1 | 10/2012 | Henderson et al. | |
| 2015/0203319 | A1* | 7/2015 | Suzuki | B65H 31/24 |
| 2016/0297214 | A1* | 10/2016 | Wakana | B65H 43/06 |
| 2016/0378045 | A1* | 12/2016 | Tsuji | G03G 15/6552 271/298 |

* cited by examiner

LATERAL TRANSLATION OF AN OUTPUT BIN BASED ON MEDIA STACK HEIGHT

BACKGROUND

Many printing systems have multiple media output collection areas where printed media is outputted. The media output collection areas are often positioned in inset locations of the printing systems and/or in a stacked relation to each other.

BRIEF DESCRIPTION OF THE DRAWINGS

Features of the present disclosure are illustrated by way of example and not limited in the following figure(s), in which like numerals indicate like elements, in which.

DETAILED DESCRIPTION

Disclosed herein are printing apparatuses that may include an output bin that may be laterally translated between a retracted position and an extended position. The printing apparatuses disclosed herein may also include a sensor to detect a height of a stack of media on the output bin while the output bin is in the retracted position. The printing apparatuses disclosed herein may further include a controller to determine whether the detected height of the media stack exceeds a certain level. In response to a determination that the detected height of the media stack exceeds the certain level, the controller may activate an actuator (e.g., drive motor) to cause the output bin (or a translatable output floor of the output bin) to be laterally translated from the retracted position to the extended position.

According to examples, the sensor may be a time-of-flight sensor that may emit photons onto a topmost sheet of media on the output tray and may receive the photons that are reflected back from the topmost sheet of media. The sensor may determine a duration of time between when the photons were emitted and when the photons were received and may correlate a distance between the sensor and the topmost sheet of media to a height of the stack of media on the output bin. Generally speaking, the time-of-flight sensor disclosed herein may more accurately detect the height of the stack of media than other types of sensors because the time-of-flight sensor may not be affected by surface properties of the media and may be more accurate than sensors that count the number of printed media sheets.

Through implementation of the printing apparatuses disclosed herein, the lateral translation of the output bin (or the translatable output floor of the output bin) may enable the media stack on the output bin to be more readily visible and accessible. In addition, by laterally translating the output bin when the height of the media stack on the output bin exceeds a certain level as also discussed herein, the media stack may be presented to a user when, for instance, the capacity of the output bin is reached. Moreover, through use of the time-of-flight sensor disclosed herein, the height of the media stack may accurately be detected even in instances in which media sheets are removed from the output bin during printing operations.

Before continuing further, it should be understood that as used herein, the terms "a" and "an" are intended to denote at least one of a particular element, the term "includes" means includes but not limited to, the term "including" means including but not limited to, and the term "based on" means based at least in part on.

Figure 1A:
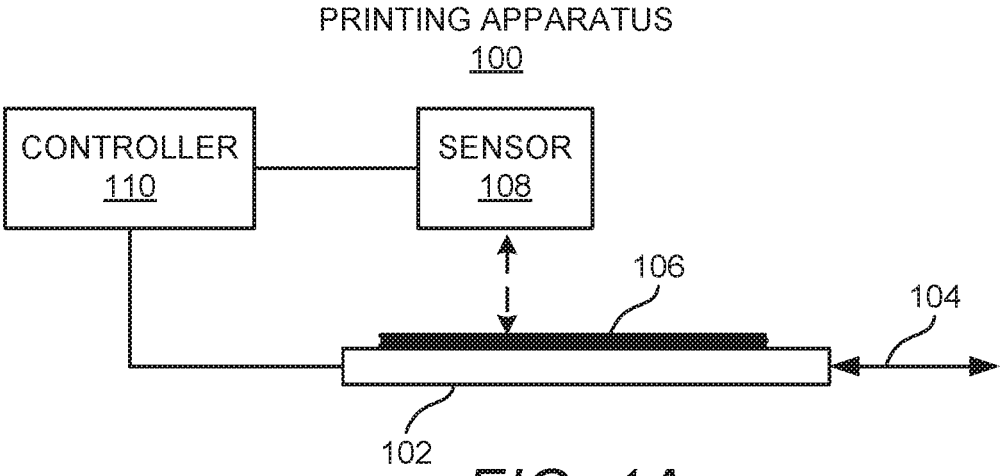
FIGS. 1A and 1B, respectively, depict a block diagram of a portion of an example printing apparatus and a block diagram of a portion of the printing apparatus depicted in FIG. 1A according to another example.

With reference first to FIG. 1A, there is shown a block diagram of a portion of an example printing apparatus 100. Generally speaking, the printing apparatus 100 may be a printer, a multi-function printer, or the like. It should be understood that the printing apparatus 100 depicted in FIG. 1A may include additional components and that some of the components described herein may be removed and/or modified without departing from a scope of the printing apparatus 100 disclosed herein.

The printing apparatus 100 may have an output bin 102 that is laterally translatable between a retracted position and an extended position as indicated by the arrow 104. The output bin 102 may be a bin, tray, receptacle, or the like, onto which media 106 may be ejected following deposition of a printing material onto the media 106. Examples of the media 106 may include any type of suitable sheet material, such as paper, card stock, transparencies, fabric, packaging material, and the like. Examples of the printing material may include ink, toner, or other type of marking material having one or multiple colors.

As discussed in greater detail herein, an actuator, e.g., a drive motor, may be implemented to translate the output bin 102 between the retracted position and the extended position. In addition, the output bin 102 may be translated from the retracted position to the extended position when the height of a stack of media 106 is detected to exceed a certain level. Although particular reference is made herein to the output bin 102 being translatable between the retracted position and the extended position, it should be understood that a portion of the output bin 102, e.g., a translatable output floor, may be translated, as discussed in greater detail herein. In this regard, reference herein to the output bin 102 being translated is also intended to encompass translation of the portion of the output bin 102.

The printing apparatus 100 may also include a sensor 108 that is to detect the height of the stack of media 106 on the output bin 102. The sensor 108 may be any suitable type of sensor, e.g., an optical sensor, a mechanical sensor, or the like, that may detect the height of the stack of media 106 on the output bin 102. By way of particular example, however, the sensor 108 may be a time-of-flight sensor (or equivalently a photon time-of-flight sensor) that may emit photons onto the topmost sheet of media 106 in the stack and may receive the photons that are reflected back from the topmost sheet of media 106. The sensor 108 may determine a duration of time between when the photons were emitted and when the photons were received and may correlate a distance between the sensor 108 and the sheet of media 106 to a height of the stack of media 106 on the output bin 102. That is, for instance, the sensor 108 may determine that the height of the stack of media 106 is higher if the duration of time is shorter and may determine that the height of the stack of media 106 is lower if the duration of time is longer. In one regard, the time-of-flight sensor disclosed herein may more accurately detect the height of the stack of media than other types of sensors because the time-of-flight sensor may not be affected by surface properties of the media 106.

The sensor 108 may communicate the detected height of the stack of media 106 to a controller 110, which may be a semiconductor-based microprocessor, a central processing unit (CPU), an application specific integrated circuit (ASIC), or other hardware device that may control various components in the printing apparatus 100. For instance, the controller 110 may determine whether the detected height of the stack of media 106 exceeds a certain level. The certain level may be user-defined and may be set, for instance, at a capacity level of the output bin 102 or at another level of the output bin 102. In response to a determination that the detected height of the stack of media 106 exceeds the certain level, the controller 110 may cause the output bin 102 to be laterally translated from the retracted position to the extended position. By way of example, the output bin 102 may be translated from the retracted position to the extended position to present the stack of media 106 to a user when the height of the stack of media 106 has reached a set capacity level of the output bin 102.

In one regard, by detecting the height of the stack of the media 106 instead of counting the sheets of media 106 as they are ejected onto the output bin 102, instances at which the stack of media 106 reaches a capacity level of the output bin 102 may more accurately be determined. That is, if a user removes a sheet or more of media 106 from the output bin 102 during printing, the total count of the media 106 sheets may inaccurately indicate that the output bin 102 is full. Additionally, sheets of media 106 may have different thicknesses or may occupy different heights with respect to each other due to differences in media 106 materials, differences in curling due to printing and drying, etc. As such, a calculated height of the stack of media 106 based upon a count of the number of sheets contained in the stack may not accurately reflect the actual height of the stack. However, by detecting the height of the stack of media 106 as disclosed herein, e.g., through use of a time-of-flight sensor, the determination of when the output bin 102 is full may more accurately be made, even in instances in which a sheet of the media 106 is removed.

Figure 1B:
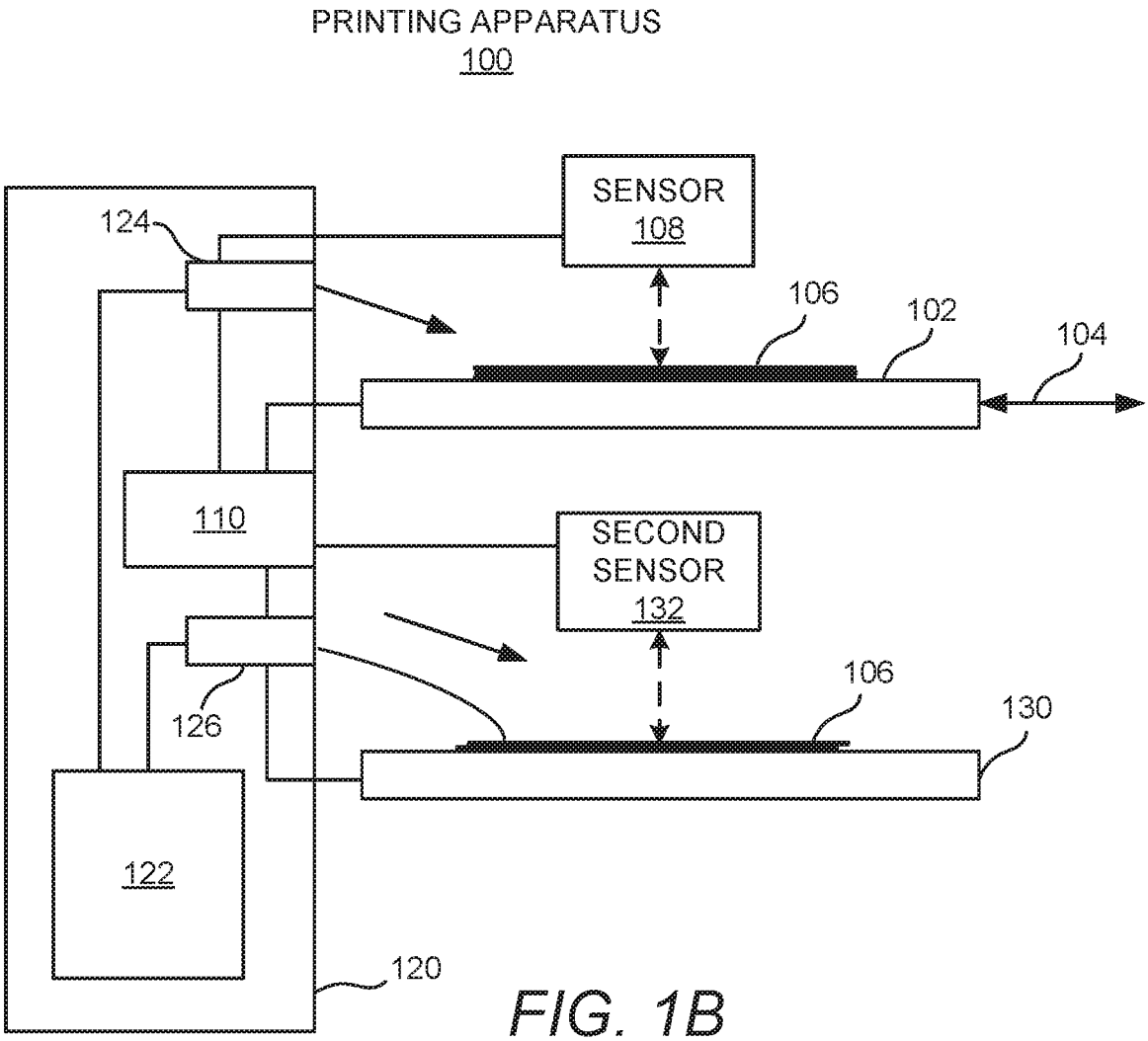

Turning now to FIG. 1B, there is shown a block diagram of a portion of the printing apparatus 100 depicted in FIG. 1A according to another example. The printing apparatus 100 depicted in FIG. 1B includes each of the elements depicted in FIG. 1A. In addition, the printing apparatus 100 may include a chassis 120 that may represent a frame and outer covering of the printing apparatus 100 within which the components of the printing apparatus 100, including the controller 110, may be housed. The chassis 120 may also house printing components 122, which may represent any mechanical, electrical, or electromechanical part of the printing apparatus 100. The printing apparatus 100 may be an inkjet printing system, a laser printing system, or the like.

An example inkjet printing system may include components such as a fluid ejection assembly (e.g., a printhead assembly), a fluid supply assembly, a carriage assembly, a print media transport assembly, a service station assembly, and an electronic controller to facilitate control of the any number of components. The printing components 122 may also include a print bar, a paper guide, a separator pad, a pinch roller, an alignment roller, a starwheel, a drum, a clamp, a servo, a pick tire, a fan, a tray, a bail, a power control unit, alignment devices, a stapler device, a hole punch device, a saddle stitching device, and the like. Example laser (e.g. toner) printing systems and may contain similar components, related components, or different components, such as toner cartridges, toner drums, etc.

The printing components 122 may direct printed media 106 through the chassis 120 to one of a first output slot 124 and a second output slot 126 in the chassis 120. The printing components 122 may eject the printed media 106 through the first output slot 124 to output the printed media 106 onto the output bin 102. In addition, the printing components 122 may eject the printed media 106 through the second output slot 126 to eject the printed media 106 onto a second output bin 130. The second output bin 130 may be a stationary bin or may laterally be translatable in manners similar to those described herein with respect to the output bin 102. In the latter example, and as shown in FIG. 1B, the printing apparatus 100 may include a second sensor 132 that may detect the height of a stack of media 106 ejected onto the second output bin 130. The second sensor 132 may be a time-of-flight sensor similar to the sensor 108 as discussed above or another type of sensor. In addition, the controller 110 may cause the second output bin 130 to be laterally translated when the second sensor 132 detects that the height of the stack of media 106 exceeds a certain level, which may be the same or may differ from the certain level corresponding to the output bin 102.

In examples, the output bin 102 may be located directly over the second output bin 130. In addition, although particular reference is made herein to the printing apparatus 100 including two output bins 102, 130, it should be understood that the printing apparatus 100 may include any number of output bins without departing from a scope of the printing apparatus 100 disclosed herein.

Figure 2A:
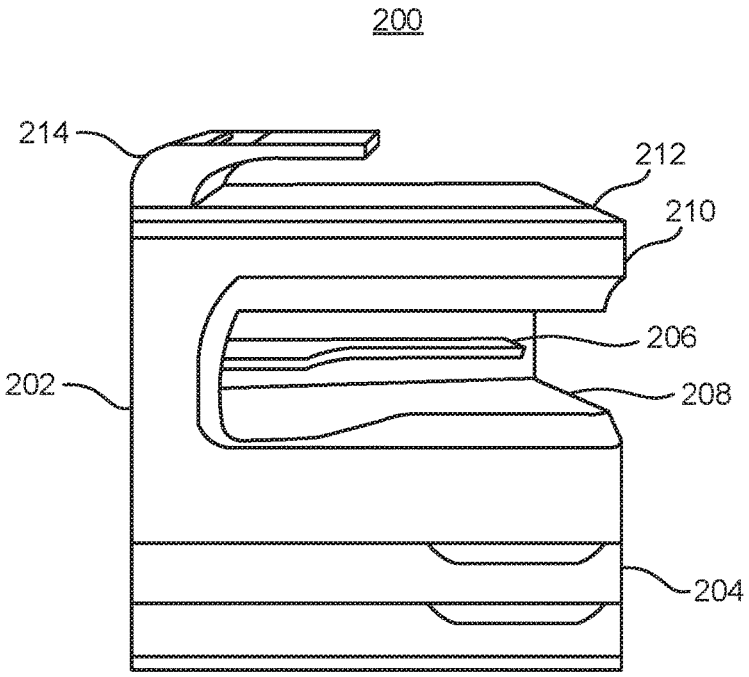
FIGS. 2A and 2B, respectively, depict a perspective view and an isometric view of an output area of an example printing apparatus.

With reference now to FIG. 2A, there is shown a perspective view of an example printing apparatus 200. The printing apparatus 200 be an inkjet multi-function device, a laser multi-function device, a laser printer, an inkjet printer, or the like, and may include the components of the printing apparatus 100 depicted in FIGS. 1A and 1B. As shown, the printing apparatus 200 may include a chassis 202 that may be similar to the chassis 120 depicted in FIG. 1B and may thus house a controller 110 and printing components 122. The printing apparatus 200 may also include media storage trays 204 that may slidably be supported in the chassis 202. The media storage trays 204 may be provided with media 106, which may be printed upon with printing materials and may be fed to one of an output bin 206 and a lower output bin 208. The output bin 206 may be equivalent to the output bin 102 and may thus be laterally translatable as discussed above with respect to FIGS. 1A and 1B. The lower output bin 208 may be equivalent to the second output bin 130.

Although not explicitly shown in FIG. 2A, a sensor 108 may be provided to detect a height of a stack of media 106 ejected onto the output bin 206 and the controller 110 may cause the output bin 206 to be laterally translated when the stack of media 106 on the output bin 206 exceeds a certain level. In addition or in other examples, the printing apparatus 200 may include a second sensor 132 to detect a height of a stack of media 106 ejected onto the lower output bin 208 and the controller 110 may cause the lower output bin 208 to be laterally translated when the stack of media 106 on the lower output bin 208 exceeds a certain level.

The printing apparatus 200 may also include a mezzanine 210 located above the output bin 206 and below a cover 212 of the printing apparatus 200 that may include a media feeding apparatus 214. The mezzanine 210 may thus be construed as an intermediate structure that is above the output bin 206 and below the cover 212. The mezzanine 210 may include a media finisher (not shown) that may perform various finishing operations on the printed media 106. The finishing operations may include, for instance, stapling, straightening, tightening, or the like, on a stack of media prior to being expelled onto the output bin 206. The mezzanine 210 may include an output slot on a lower portion of the mezzanine 210 through which media 106 may be dropped onto the output bin 206 following performance of the finishing operations. As shown in FIG. 2A, the mezzanine 210 may have a larger footprint than the output bin 206 and thus, media 106 on the output bin 206 may not be clearly visible, particularly when the output bin 206 is in the retracted position. Particularly, the output bin 206 may be inset within the chassis 202 and thus, accessible edges of a finished stack of media 106 sheets may be placed back where the media 106 is not visible. Even when viewed from a distance, the media 106 stack may be difficult to view. Further, access to the media 106 stack may be difficult.

Figure 2B:
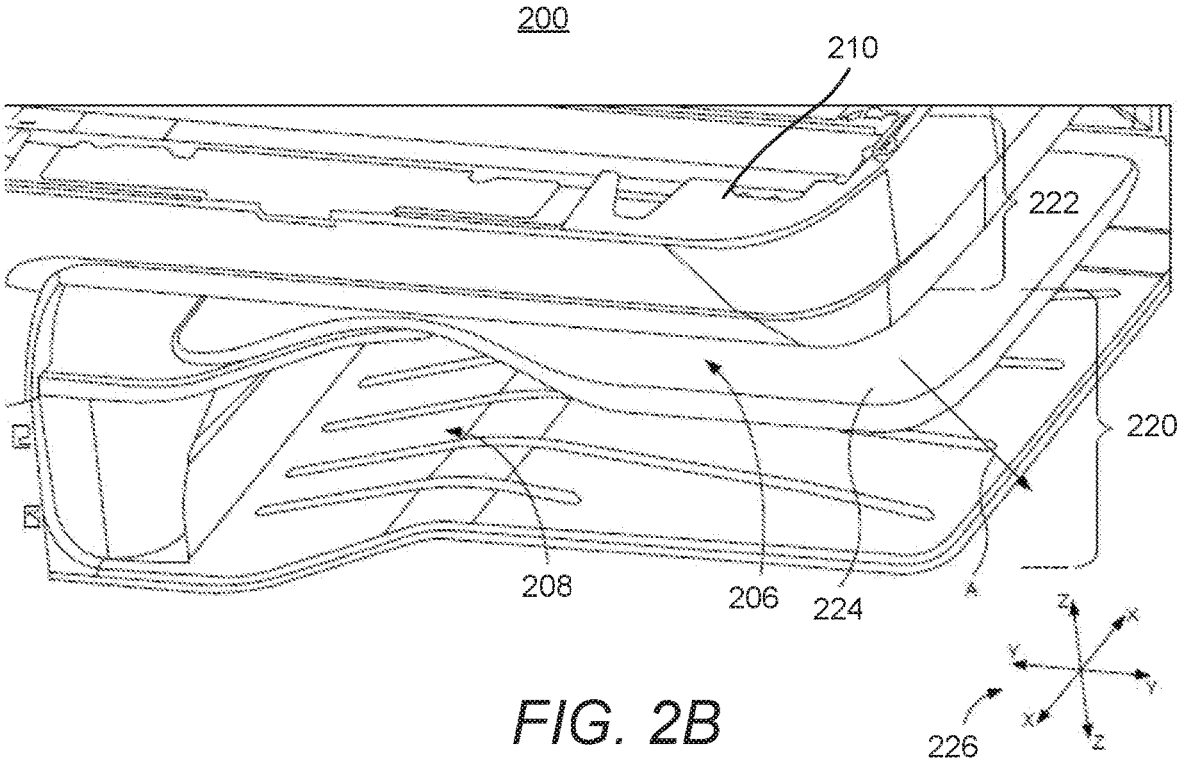

FIG. 2B shows an isometric view of an output area 220 of the printing apparatus 200 depicted in FIG. 2A. According to examples, the lower output bin 208 may be reserved for non-collated print jobs that include a plurality of printed media 106 not subjected to an alignment process, a stapling process. a hole punching process, a binding process, an embossing process, a gluing process, or another finishing process. In addition, the output bin 206 may be used to receive media sheets that have been collated, subjected to a finishing process, or a combination thereof, and may include a finisher output bin assembly as will be described in more detail herein. Even though the lower output bin 208 has been depicted in the printing apparatus 200, the lower output bin 208 may not be included in one example. In this example, the output bin 206 may be used as the output tray for both finished and unfinished media 106 sheets.

The output area 220 of the printing apparatus 200 may further include a finisher device 222 located in the mezzanine 210. The finisher device 222 may include elements and devices that assist in performing a number of finishing processes as discussed above. The media 106 sheets may be transported through the finisher device 222, and may be deposited onto an output bin assembly 224 located within the output bin 206. In FIG. 2B, the output bin assembly 224 is depicted as being in an extended position or state in which the output bin assembly 224 moves in the Y direction to the right and the X direction towards the front of the printing apparatus 200 as indicated by the arrow A.

Throughout the figures, a three-dimensional Cartesian coordinate indicator 226 is depicted to orient the reader as to directions of movement and forces placed on and interaction between the various elements within the output bin 206 of the printing apparatus 200. As depicted in FIG. 2B, a user may approach the printing apparatus 200 from the front as indicated by the Y, Z plane. Further, an X, Z plane to the far right of the printing apparatus 200 depicted in FIG. 2B is the right-hand side of the printing apparatus 200 where printed media 106 sheets may be ejected from the printing apparatus 200.

According to examples discussed herein, the lateral translation of the output bin 206 and/or the output bin assembly 224 may enable the media 106 stack on the output bin 206 to be more readily visible and accessible. In addition, by laterally translating the output bin 206 when the height of the media 106 stack on the output bin 206 exceeds a certain level as also discussed herein, the media 106 stack may be presented to a user when, for instance, the capacity of the output bin 206 is reached.

Figure 3:
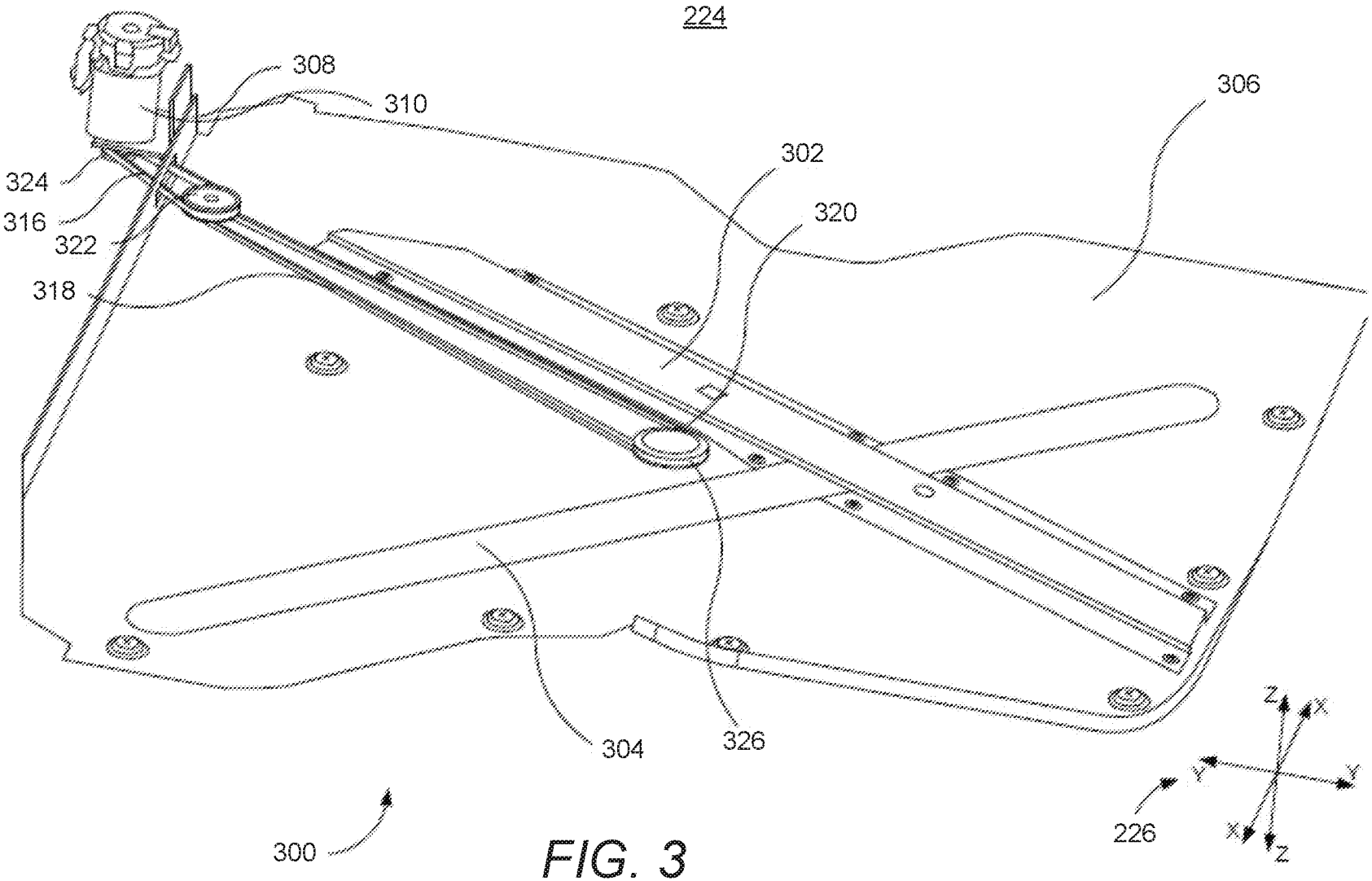
FIG. 3 depicts an isometric view of an output structure of the output bin assembly depicted in FIG. 2B.
Figure 4:
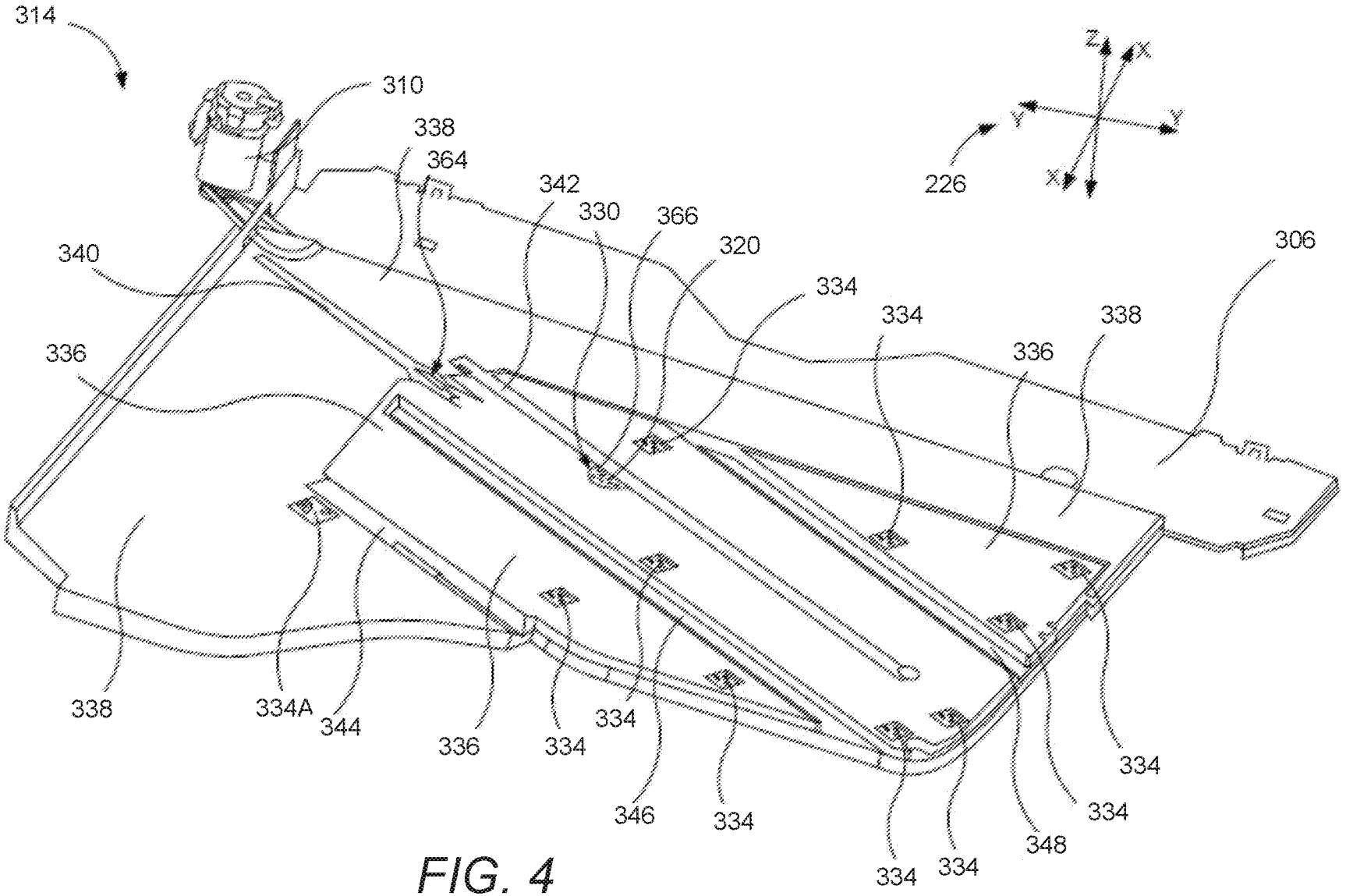
FIG. 4 depicts an isometric view of a guide substrate of the output bin assembly depicted in FIG. 2B.
Figure 5:
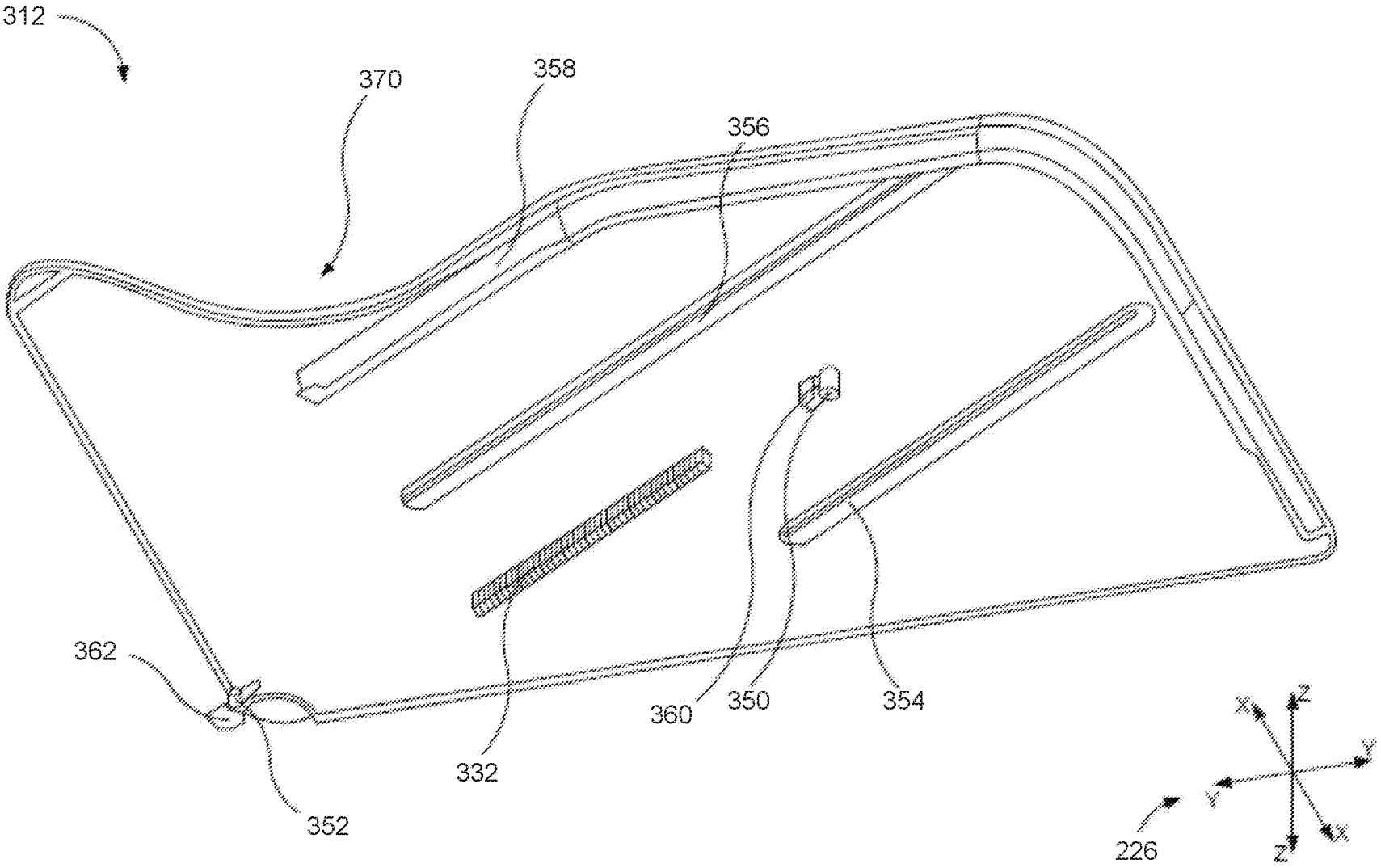
FIG. 5 depicts an isometric view of a bottom of an example translatable output floor that is coupled to the guide substrate shown in FIG. 4 of the output bin assembly.

Details regarding the output bin assembly 224 will now be provided in connection with FIGS. 3-5. FIG. 3 depicts an isometric view of an output structure 300 of the output bin assembly 224 depicted in FIG. 2B. FIG. 4 depicts an isometric view of a guide substrate 314 of the output bin assembly 224. FIG. 5 depicts an isometric view of a bottom of a translatable output floor 312 that is coupled to the guide substrate 314 shown in FIG. 4 of the output bin assembly 224. Beginning with the output structure 300 depicted in FIG. 3, a number of cross-bars 302, 304 may be coupled to or formed into a base plate 306 to provide rigidity to the output structure 300 and the output bin assembly 224. In some examples, the base plate 306 may be made of sheet metal, plastic, combinations thereof, or the like.

The output structure 300 may be coupled to an infrastructure, e.g., the chassis 202, of the printing apparatus 200 via a coupling wall 308, via the base plate 306, or a combination thereof. The coupled position of the output structure 300 relative to the printing apparatus 200 may define where media 106 sheets are deposited on the output bin assembly 224. Therefore, in the examples described herein, the output bin assembly 224 may be coupled to the printing apparatus 200 below an output slot 124 in the chassis 202 as shown in FIG. 1B.

A drive motor 310 may be coupled to the coupling wall 308. In some examples, the drive motor 310 may be positioned outside the finisher device 222. The drive motor 310 may provide the force to move a translatable output floor 312 relative to the guide substrate 314 as will be described in more detail below. In some examples, the drive motor 310 may be a servomotor in order to utilize the precision provided by the servomotor. However, in other examples, the drive motor 310 may be a stepper motor or another type of drive motor. As discussed herein, the controller 110 may control the drive motor 310 to extend and retract the output bin 102, 206.

At least one drive belt 316, 318 may mechanically couple the drive motor 310 to at least one gear 320. However, in other examples, the drive system of the guide substrate 314 may include all gears and no belts to transmit power to the gear 320. In the example of FIG. 4, a first drive belt 316 may be coupled between the drive motor 308 and a reduction wheel 322. A second drive belt 318 may be coupled between the reduction wheel 322 and the gear 320. In this example, the first drive belt 316, reduction wheel 322, and second drive belt 318 may form a two-stage belt reduction system. The diameters of a drive wheel 324 of the drive motor 310, the reduction wheel 322, and a belt interface 326 of the gear 320 define a desired the output speed of the gear 320 and the level of torque provided by the gear 320. In some examples, the output speed and torque of the two-stage belt reduction system provides a user with a timely presented stack of media sheets while also functioning in a manner that creates an impression of a smooth and precisely functioning printing apparatus 200. In some examples, any number of gears, pulleys, or a combination thereof may be used within the two-stage belt reduction system.

Turning to FIGS. 4 and 5, the guide substrate 314 may be coupled to the output structure 300. The guide substrate 314 may include a gear aperture 330 that allows the gear 320 of the output structure 300 to protrude through the gear aperture 320 and interface with a rack 332 coupled to or formed on the translatable output floor 312 as depicted in FIG. 5. The guide substrate 314 may further include a number of rollers 334, 334A that may reduce or eliminate friction between the guide substrate 314 and the translatable output floor 312. In some examples, the rollers 334, 334A may each include a shaft coupled to the guide substrate 314 and a wheel coupled to the shaft. In this manner, the rollers 334, 334A may freely rotate as the translatable output floor 312 slides with respect to the guide substrate 314. In order to house the rollers 334, the guide substrate 314 may include a sub-plate 336 formed with a main plate 338. The main plate 338 may include a recessed portion in which the sub-plate 336 is formed. When the sub-plate 336 is formed within the recess of the main plate 338, the elevation of the two surfaces may approximately be equal. In some examples, the rollers 334 may be coupled to the sub-plate 336, and may be housed between the sub-plate 336 and the main plate 338. In another example, the coupling of the translatable output floor 312 to the guide substrate 314 may retain the rollers 334 within the system. In still another example, the rollers 334 may snap into seating retainers formed in the guide substrate 314. A number of rollers 334 may be included on the main plate 338 as well. In some examples, the rollers 334 coupled to the main plate 338 may be raised to match the height of the rollers 334 disposed on the sub-plate 336.

Turning now to both FIGS. 4 and 5, the guide substrate 314 may further include a number of guide recesses 340, 342, 344, 346, 348 that may interface with a number of guide pins 350, 352 and a number of guide protrusions 354, 356, 358 coupled to or formed on the bottom of the translatable output floor 312. First, the guide pins 350, 352 may interface with guide recesses 340, 342. As depicted in FIGS. 4 and 5, the guide pins 350, 352 may include retainers 360, 362 that, during manufacture, for example, are coupled to the guide recesses 340, 342. In some examples, the retainers 360, 362 may include flexible snap arms that are biased in an outward direction from one another. The flexible snap arms of the guide recesses 340, 342 may deflect inwardly towards one another and snap into and interface with channels defined along both sides of the length of the guide recesses 340, 342. In some examples, a number of apertures 364 that allow the retainers 360, 362 to fit into the channels defined in the guide recesses 340, 342. In this manner, the retainers 360, 362 may slidably couple the translatable output floor 314 to the guide substrate 312. However, any coupling process or device may be used to slidably couple the translatable output floor 314 to the guide substrate 312. Guide recess 342 may be defined within the guide substrate 312 to provide clearance to the rack in connection with the retention device 366 disposed within the guide recess 342.

The remainder of the guide recesses 344, 346, 348 defined on the guide substrate 312 interface with the remainder of the guide protrusions 354, 356, 358 coupled to or formed on the translatable output floor 314. The interface between the guide recesses 344, 346, 348 and guide protrusions 354, 356, 358 may serve to ensure that the movement of the translatable output floor 312 relative to the guide substrate 314 does not shift from an intended direction of movement as defined by the position and direction of the guide recesses 340, 342, 344, 346, 348.

In some examples, the translatable output floor 312 may include a cutaway 370 defined in the side thereof. With reference to FIG. 2B, the translatable output floor 312 of the finisher output bin assembly 224 is depicted since it is the top-most element of the output bin assembly 224. As depicted in FIG. 2B, the cutaway 370 serves to provide the user with a direct line of sight to at least a portion of the lower output bin 208 located below the output bin 206 in which the output bin assembly 224 is located. This may allow for the user to readily see and access printed media 106 sheets that are ejected to the lower output bin 208. As described herein, the output bin assembly 224 may translate printed media 106 sheets that are ejected to the output bin 206 to provide visual and tangible access to the printed media 106 sheets dispensed therein. Thus, in this manner, a user may readily see and have access to printed media sheets regardless of which output tray 206, 208 the printed media 106 sheets are ejected when the output bin assembly 224 is in either a retracted state or an extended state because of the cutaway 370. In one example, sheets of media may be ejected to the lower output tray 208 such that they are biased in the negative Y-direction to the left as depicted in FIG. 2B. This may be achieved using, for example, an inclined output tray floor in the lower output bin 208, a media feed path upstream from the lower output bin 208 that may ensure left biasing, or another mechanism that biases the media 106 sheets to the left. In contrast, the media 106 sheets ejected to the output bin 206 and onto the output bin assembly 224 may be biased in the positive Y-direction to the right as depicted in FIG. 2B. In this manner, media 106 sheets ejected in the two output bins 206, 208 may visually and spatially be separated in order to assist a user in deciphering between the two output bins 206, 208.

Turning again to the interfacing between the guide substrate 314 and the translatable output floor 312 and FIGS. 4 and 5, the gear 220 may mesh with the rack 332 to form a rack and pinion gear set. Rack and pinion gear sets include a circular gear called a pinion such as gear 320 that engages equally spaced teeth of a linear gear called a rack such as rack 332 to convert rotational motion to linear motion. While the example of FIG. 3 includes a rack to provide linear motion, any alternative motion may be achieved by including a combination of any number of curved output toothed devices and straight racks operating together with a number of appropriately-shaped guide recesses 340, 342, 344, 346, 348.

In the example of FIG. 3, the pinion 320 may be meshed with the rack 332, and the linear nature of the gear rack 332 converts the pinion's 320 rotary motion into linear motion. In this manner, a rack 332 and pinion gear 320 may be used as a linear actuator to move the translatable output floor 312 relative to the guide substrate 314. Because rack and pinion sets have relatively few components, they may help save time in manufacturing and installation, increase reliability, and provide high levels of accuracy even over long travel lengths. In order for the rack 332 and pinion 320 gears to work together or mesh, they may include compatible features such as diametral pitch and pressure angle.

In some examples, a retention device 466 may be included in the guide substrate 314 to ensure that the rack 332 engages and meshes with the pinion gear 320. In this example, the retention device 466 may be included within guide recess 342, and narrows the space within the guide recess 342 to provide a constant force on the rack 332 to push the rack 332 into engagement with the pinion gear 320 and to ensure that the rack 332 and pinion gear 320 do not disengage and cause damage to the rack 332 or pinion gear 320, or cause the output bin assembly 224 to malfunction.

In some examples, the translatable output floor 312 may include a number of relatively higher friction elements or a relatively higher friction coating on at least a portion of the top surface of the translatable output floor 312. This friction coating may enable the translatable output floor 312 to carry stacks of media 106 sheets without the media 106 sheets slipping along the top surface of the translatable output floor 312. For example, if the translatable output floor 312 is made of a plastic or metal, is may be possible that the media sheets may move relative to their original deposition location over the surface of the translatable output floor 312. The relatively higher friction elements or coating may cause the stack of media 106 sheets to remain in the original deposition location during translation of the stack to the extended position of the translatable output floor 312.

Figure 6:
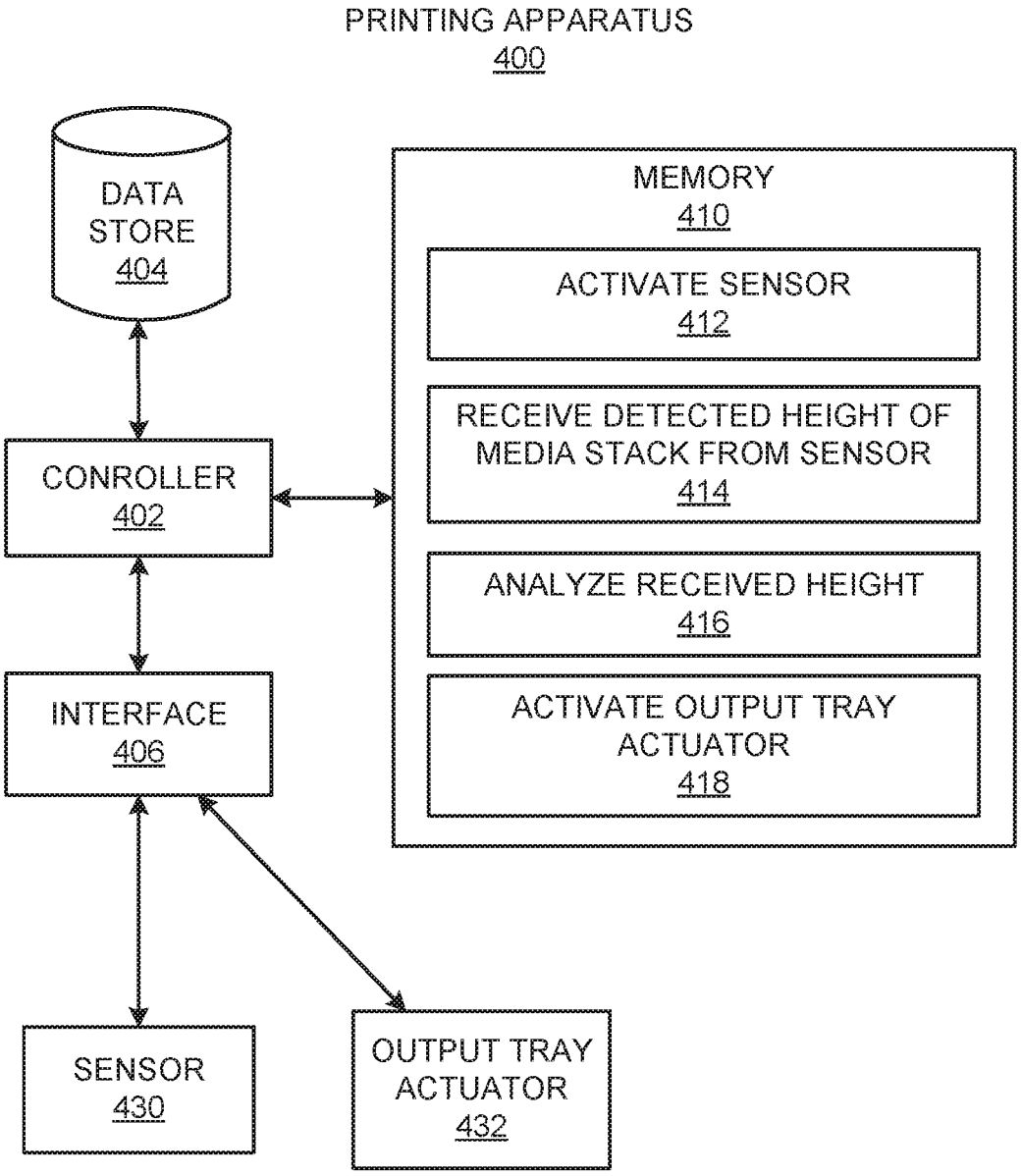
FIG. 6 depicts a block diagram depicting an example printing apparatus.

Turning now to FIG. 6, there is shown a block diagram depicting an example printing apparatus 400. It should be understood that the printing apparatus 400 depicted in FIG. 6 may include additional components and that some of the components described herein may be removed and/or modified without departing from a scope of the printing apparatus 400 disclosed herein. The description of the printing apparatus 400 is made with reference to the printing apparatuses 100, 200 depicted in FIGS. 1A-3.

The printing apparatus 400 may include a controller 402 that may control operations of the printing apparatus 400. The controller 402 may be a semiconductor-based microprocessor, a central processing unit (CPU), an application specific integrated circuit (ASIC), a field-programmable gate array (FPGA), and/or other hardware device. The controller 402 may access a data store 404, which may be a Random Access Memory (RAM), an Electrically Erasable Programmable Read-Only Memory (EEPROM), a storage device, an optical disc, and the like.

The printing apparatus 400 may also include an interface 406 through which the controller 402 may communicate instructions to a plurality of components contained in the printing apparatus 400, including a sensor 430 and an output tray actuator 432. The interface 406 may be any suitable hardware and/or software through which the controller 402 may communicate the instructions. In some examples, the interface 406 may also enable communication of information from the components to the controller 402.

The printing apparatus 400 may also include a memory 410 that may have stored thereon machine readable instructions 412-418 (which may also be termed computer readable instructions) that the controller 402 may execute. The memory 410 may be an electronic, magnetic, optical, or other physical storage device that contains or stores executable instructions. The memory 410 may be, for example, Random Access memory (RAM), an Electrically Erasable Programmable Read-Only Memory (EEPROM), a storage device, an optical disc, and the like. The memory 410, which may also be referred to as a computer readable storage medium, may be a non-transitory machine-readable storage medium, where the term "non-transitory" does not encompass transitory propagating signals.

The controller 402 may fetch, decode, and execute the instructions 412 to activate the sensor 430, which may be a photon time-of-flight sensor, to detect a height of a stack of media 106 on an output bin 102, 206 (or equivalently, output tray 102, 206). The controller 402 may fetch, decode, and execute the instructions 414 to receive a detected height of the stack of media 106 from the sensor 430. The controller 402 may fetch, decode, and execute the instructions 416 to analyze the received height of the stack of media 106. The controller 402 may fetch, decode, and execute the instructions 418 to activate the output tray actuator 432 to cause the output tray 102, 206 (or equivalently, a translatable output floor 312 of the output tray 102, 206 to be laterally translated.

The computer readable storage medium 410 may be any electronic, magnetic, optical, or other physical storage device that contains or stores executable instructions. Thus, the computer readable storage medium 410 may be, for example, Random Access Memory (RAM), an Electrically Erasable Programmable Read-Only Memory (EEPROM), a storage device, an optical disc, and the like. The computer readable storage medium 410 may be a non-transitory machine-readable storage medium, where the term "non-transitory" does not encompass transitory propagating signals.

Figure 7:
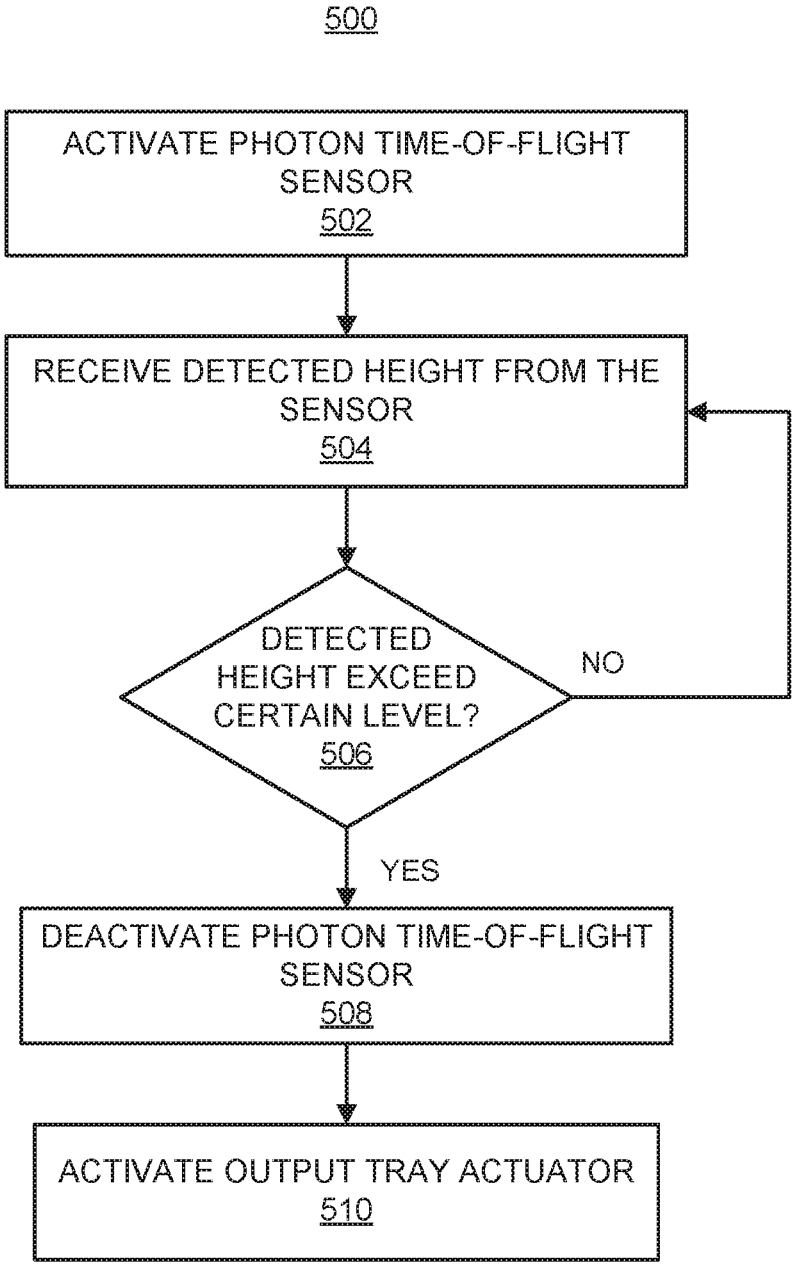
FIG. 7 depicts an example method for laterally translating an output tray responsive to a detected media stack height.

Various manners in which the printing apparatus 400 may be implemented are discussed in greater detail with respect to the method 500 depicted in FIG. 7. Particularly, FIG. 7 depicts an example method 500 for laterally translating an output tray 102, 206 responsive to a detected media stack height. It should be apparent to those of ordinary skill in the art that the method 500 may represent generalized illustrations and that other operations may be added or existing operations may be removed, modified, or rearranged without departing from the scope of the method 500.

The description of the method 500 is made with reference to the apparatuses 100, 200, 400 illustrated in FIGS. 1A-1C, 2A-2B, and 4 and the 3D printer 300 illustrated in FIG. 4 for purposes of illustration. It should, however, be understood that apparatuses and 3D printers having other configurations may be implemented to perform the method 500 without departing from a scope of the method 500. The description of the method 500 is made with respect to the printing apparatuses 100, 200, and 400 depicted FIGS. 1A-4 for purposes of illustration. It should, however, be understood that the method 500 may be implemented in a printing apparatus having a different configuration than those depicted in FIGS. 1A-4.

At block 502, a photon time-of-flight sensor 108, 430 may be activated to detect a height of a stack of media 106 on an output tray 102, 206. As discussed herein, the output tray 102, 206 may include a translatable output floor 312 and the sensor 108, 430 may detect the height of the stack of media 106 while the translatable output floor 312 is in a retracted position. That is, for instance, the controller 402 may execute the instructions 412 to activate the sensor 108, 430 while the translatable output floor 312 is in the retracted position.

According to examples, the controller 402 may initiate the method 500 in response to printed media 106 being ejected onto the output tray 102, 206 during a printing operation. In addition, the controller 402 may maintain the sensor 108, 430 in an activated state during the printing operation. The controller 402 may also re-initiate the method 500 in response to the printing apparatus 100, 200, 400 performing another printing operation.

At block 504, the controller 402 may execute the instructions 414 to receive the detected height of the media 106 stack from the sensor 108, 430. In addition, at block 506, the controller 402 may execute the instructions 416 to determine whether the detected height of the stack of media 106 exceeds a certain level. The certain level may be user-defined and may be set for instance, at a capacity level of the output tray 102, 206.

In response to a determination at block 506 that the detected height of the media 106 stack does not exceed the certain level, the controller 402 may continue to receive the detected height of the media 106 stack on the output tray 102, 206. The controller 402 may continue to receive the detected height of the media 106 stack on the output tray 102, 206 until a current print job is completed or until the detected height is determined to exceed the certain level at block 506. In response to a determination that the detected height exceeds the certain level at block 506, the controller 402 may deactivate the photon time-of-flight sensor 108, 430 as indicated at block 508. In addition, at block 510, the controller 402 may execute the instructions 418 to activate an output tray actuator 432 to laterally translate the translatable output floor 312 to an extended position from the retracted position. The output tray actuator 432 may be equivalent to the drive motor 310 discussed above with respect to FIG. 3.

The controller 402 may also activate the output tray actuator 432 to laterally translate the translatable output floor 312 from the extended position to the retracted position following a determination that the stack of media sheets has been removed from the output tray 102, 206. The controller 402 may make this determination based upon a detected height by the sensor 108, 430. The controller 402 may additionally or in other examples make this determination based upon whether another sensor (not shown) detected the presence of media 106 on the output tray 102, 206.

Some or all of the operations set forth in the method 500 may be contained as programs or subprograms in any desired computer accessible medium. In addition, the method 500 may be embodied by a computer program, which may exist in a variety of forms both active and inactive. For example, the method 500 may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A printing apparatus comprising:

an output bin, the output bin being laterally translatable between a retracted position and an extended position;

a sensor to detect a height of a stack of media on the output bin while the output bin is in the retracted position; and a controller to:

determine whether the detected height of the stack of media on the output bin exceeds a certain level; and in response to a determination that the detected height of the stack of media exceeds the certain level, laterally translate the output bin from the retracted position to the extended position.

2. The printing apparatus according to claim 1, further comprising:

a chassis, the output bin including a proximal end connected to the chassis and a distal end of the output bin being closer to the chassis when the output bin is in the retracted position than when the output bin is in the extended position.

3. The printing apparatus according to claim 1, wherein the sensor emits photons onto the media, receives photons that are reflected back from the media, and determines a duration of time between when the photons are emitted and when the photons are received to determine a distance between the sensor and the stack of media, and to detect the height of the stack of media from the determined distance.

4. The printing apparatus according to claim 1, further comprising:

a lower output bin; and a mezzanine located above the lower output bin, the output bin being located between the lower output bin and the mezzanine.

5. The printing apparatus according to claim 4, further comprising:

a media finisher housed in the mezzanine, the media being transported from a printing zone and to the media finisher in the mezzanine prior to being ejected onto the output bin.

6. The printing apparatus according to claim 4, further comprising:

a second sensor to detect a height of a stack of media on the lower output bin.

7. The printing apparatus according to claim 1, wherein the output bin includes a translatable output floor, said printing apparatus further comprising:

a mechanical structure coupled to the translatable output floor, the mechanical structure including a drive motor and a translating component, the controller being to control the drive motor to drive the translating component, and movement of the translating component causing the translatable output floor to translate laterally.

8. A printing apparatus comprising:

a first output bin;

a mezzanine located above the first output bin;

a second output bin located between the first output bin and the mezzanine, the second output bin including a translatable output floor that is laterally movable between a retracted position and an extended position;

a sensor to detect a height of a stack of media on the second output bin while the second output bin is in the retracted position; and a controller to:

determine whether the detected height of the stack of media on the second output bin exceeds a certain level; and in response to a determination that the detected height of the stack of media exceeds the certain level, laterally move the second output bin from the retracted position to the extended position.

9. The printing apparatus according to claim 8, further comprising:

a chassis, the second output bin including a proximal end connected to the chassis and the translatable output floor including a distal end that is closer to the chassis when the second output bin is in the retracted position than when the second output bin is in the second position.

10. The printing apparatus according to claim 8, wherein the sensor emits photons onto the media, receives photons that are reflected back from the media, and determines a duration of time between when the photons are emitted and when the photons are received to determine a distance between the sensor and the stack of media, and to detect the height of the stack of media from the determined distance.

11. The printing apparatus according to claim 8, further comprising:

a media finisher housed in the mezzanine to implement finishing operations on media prior to the media being ejected onto the second output bin.

12. The printing apparatus according to claim 8, further comprising:

a second sensor to detect a height of a stack of media on the first output bin.

13. The printing apparatus according to claim 8, further comprising:

a mechanical structure coupled to the translatable output floor, the mechanical structure including a drive motor and a translating component, the controller being to control the drive motor to drive the translating component, and movement of the translating component causing the translatable output floor to translate laterally.

14. A method comprising:

activating a photon time-of-flight sensor to detect a height of a stack of media on an output tray having a translatable output floor, while the translatable output floor is in a retracted position;

receiving the detected height of the stack of media from the photon time-of-flight sensor;

determining whether the detected height of the stack of media exceeds a certain level; and in response to a determination that the detected height of the stack of media exceeds the certain level, activating an output tray actuator to laterally translate the translatable output floor to an extended position from the retracted position.

15. The method according to claim 14, said method further comprising:

laterally translating the translatable output floor to the extended position by moving the translatable output floor diagonally with respect to a chassis on which the output tray is supported.

* * * * *